US006209183B1

(12) United States Patent
Bugosh

(10) Patent No.: US 6,209,183 B1
(45) Date of Patent: Apr. 3, 2001

(54) BUSHING INSTALLATION TOOL

(75) Inventor: Mark J. Bugosh, Sterling Heights, MI (US)

(73) Assignee: TRW Inc., Lyndhurst, OH (US)

( * ) Notice: Subject to any disclaimer, the term of this patent is extended or adjusted under 35 U.S.C. 154(b) by 0 days.

(21) Appl. No.: 09/421,055

(22) Filed: Oct. 19, 1999

(51) Int. Cl.[7] ..... B25B 27/14
(52) U.S. Cl. ..... 29/280
(58) Field of Search ..... 29/280, 263, 255, 29/282, 229, 235

(56) References Cited

U.S. PATENT DOCUMENTS

| | | | | |
|---|---|---|---|---|
| 1,603,471 | | 10/1926 | Johnson et al. . | |
| 3,553,817 | * | 1/1971 | Lallak | 29/235 |
| 4,807,343 | * | 2/1989 | Wadsworth | 29/235 |
| 5,050,282 | * | 9/1991 | Zannini | 29/235 |
| 5,355,572 | | 10/1994 | Kammeraad et al. . | |
| 5,890,271 | | 4/1999 | Bromley et al. . | |

* cited by examiner

*Primary Examiner*—Robert C. Watson
(74) *Attorney, Agent, or Firm*—Tarolli, Sundheim, Covell, Tummino & Szabo L.L.P.

(57) ABSTRACT

A tool (10) for installing a radially compressible bushing (20) into a housing (30) of a rack and pinion steering system (32). The housing has an end portion (50) that includes a ring-shaped bushing chamber (72) and a circular opening (60) into the bushing chamber. The opening (60) has a first diameter, and the bushing chamber (72) has a second diameter greater than the first diameter of the circular opening. The tool (10) comprises a plunger (80) having a first portion (90) with an outer diameter that is less than the first diameter of the opening (60) in the housing (30). The first portion (82) of the plunger (80) has a circumferential groove (94) defined by a pair of annular end surfaces (96, 98) and a cylindrical base surface (100). The groove (94) receives the bushing (20) during installation of the bushing in the housing (30). The annular end surfaces (96, 98) of the groove (94) block axial movement of the bushing (20) along the plunger (80) while the bushing is on the plunger. The tool (10) also includes a sleeve (110) slidable along the first portion (82) of the plunger (80) to radially compress the bushing (20) and hold the bushing in the groove (94) during installation of the bushing in the housing (30).

5 Claims, 3 Drawing Sheets

BUSHING INSTALLATION TOOL

BACKGROUND OF THE INVENTION

1. Technical Field

The present invention relates to a rack and pinion steering gear assembly and, in particular, is directed to a tool for installing a rack bushing into a housing of an electric power assisted rack and pinion steering gear assembly.

2. Description of the Prior Art

A typical electric power assisted rack and pinion steering gear assembly for a vehicle includes a rack which extends axially through a housing. The ends of the rack project from the ends of the housing and are connected with steering linkage which connects to steerable vehicle wheels. The rack is supported at one end of the housing for axial movement within the housing upon actuation of an electric motor. This support is provided by a rack bushing that is received and supported in an outboard end portion of the housing.

SUMMARY OF THE INVENTION

The present invention is a tool for installing a bushing into a housing of a rack and pinion steering system. The housing has an end portion that includes a ring-shaped bushing chamber and a circular opening into the bushing chamber. The opening has a first diameter, and the bushing chamber has a second diameter greater than the first diameter of the circular opening. The bushing is radially compressible between a first, fully expanded state and a second, fully compressed state. The bushing when in the bushing chamber is partially expanded.

The tool comprises a plunger having a first portion with an outer diameter that is less than the first diameter of the opening in the housing. The first portion of the plunger has a circumferential groove defined by a pair of annular end surfaces extending radially inward from the outer surface and a cylindrical base surface extending axially between the end surfaces at a location radially inward of the outer surface. The groove receives the bushing during installation of the bushing in the housing. The annular end surfaces of the groove block axial movement of the bushing along the first portion of the plunger while the bushing is on the plunger. The tool also includes a sleeve slidable along the first portion of the plunger to radially compress the bushing and hold the bushing in the groove during installation of the bushing in the housing.

BRIEF DESCRIPTION OF THE DRAWINGS

The foregoing and other features of the present invention will become apparent to one skilled in the art to which the present invention relates upon consideration of the following description of the invention with reference to the accompanying drawings, wherein.

DESCRIPTION OF A PREFERRED EMBODIMENT OF THE INVENTION

Figure 1:
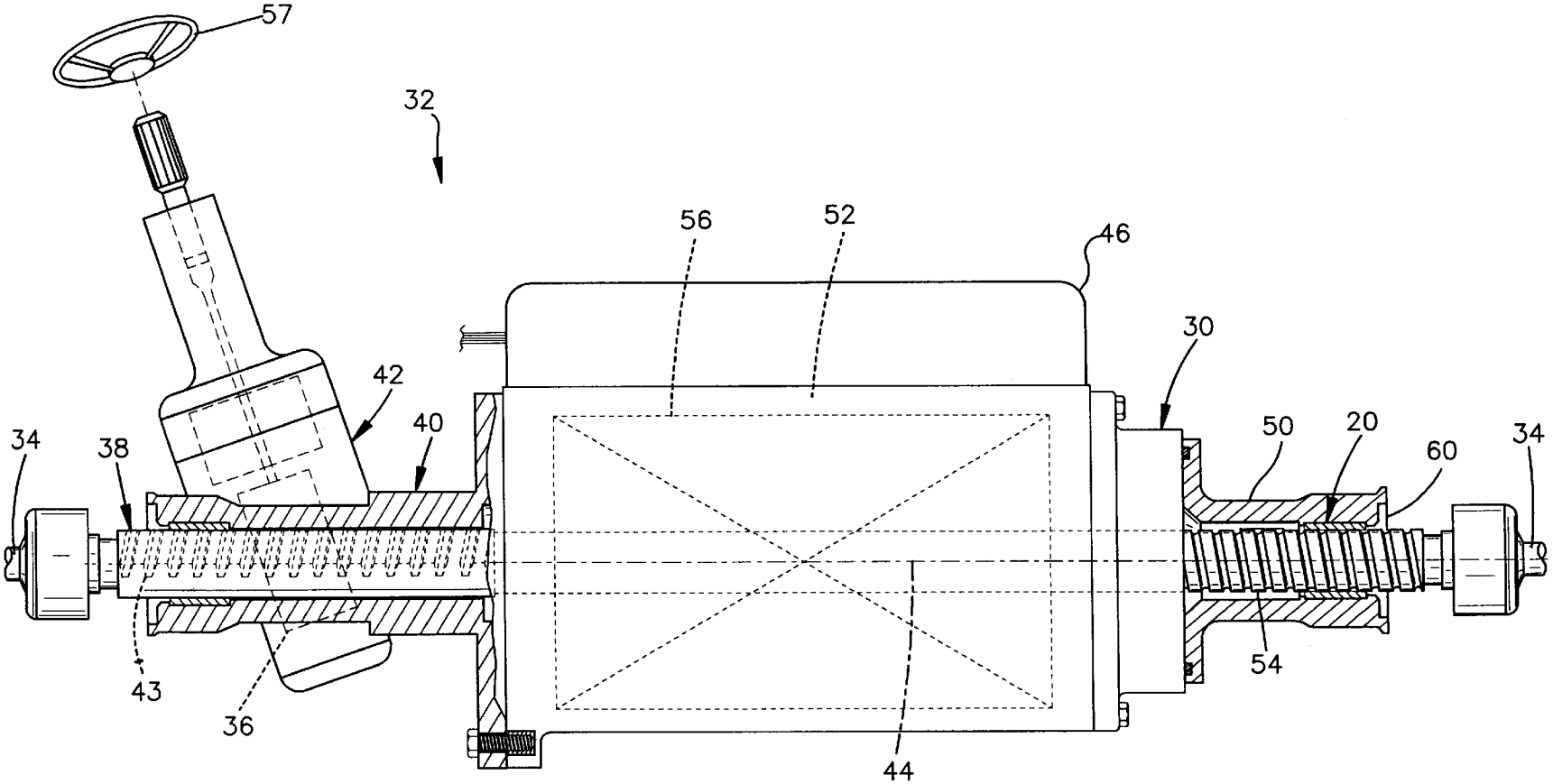
FIG. 1 is a schematic view of a vehicle rack and pinion steering gear including a housing supporting a rack bushing.
Figure 2:
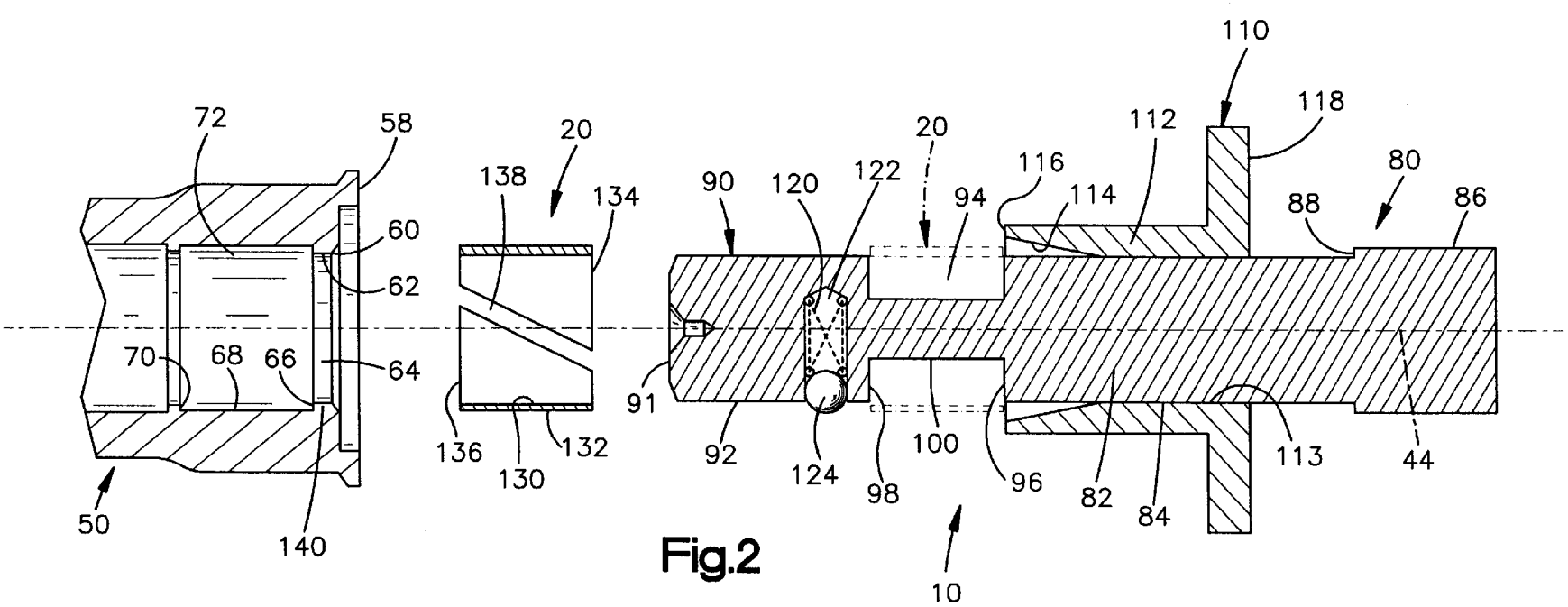
FIG. 2 is a sectional view of a portion of the housing including the bushing and also showing a bushing installation tool constructed in accordance with the present invention.

The present invention relates to a rack and pinion steering gear and, in particular, is directed to a tool for installing a bushing in a housing of an electric power assisted rack and pinion power steering gear. The present invention is applicable to various tool constructions. As representative of the present invention, FIG. 2 illustrates a tool 10.

The tool 10 is used for installing a bushing 20 (FIG. 2) in a housing 30 of a rack and pinion power steering gear 32. The steering gear 32 is connected with a pair of steerable vehicle wheels (not shown) in a known manner by steering linkage 34 at opposite ends of the steering gear.

In addition to the housing 30, the steering gear 32 includes a pinion 36 and a rack 38. The housing 30 has a rack portion 40 and a transversely extending pinion portion 42. The pinion 36 is disposed in the pinion portion 42 of the housing 30. The pinion 36 has teeth (not shown) which meshingly engage teeth 43 on the rack 38 inside the housing 30 at the intersection of the pinion portion 42 and the rack portion 40.

The rack portion 40 of the housing 30 has a tubular, cylindrical configuration centered on an axis 44. The housing 30 has a main body portion 46 and an outboard end portion. The main body portion 46 of the housing defines a motor chamber 52 (FIG. 2) within the housing 30.

The rack 38 is centered on the axis 44 and extends axially through the motor chamber 52. The rack 38 has a cylindrical outer surface 54. Opposite ends of the rack 38 project axially beyond the end portions 48 and 50 of the housing 30 and are connected to the steering linkages 34.

An electric motor shown schematically at 56 is drivingly associated with the rack 38 inside the motor chamber 52. Upon rotation of the vehicle steering wheel 57, the motor 56 is actuated, causing the rack 38 to move axially within the housing 30. Such axial movement of the rack 38 in opposite directions moves the steering linkages 34 in opposite directions, and thus turns the steerable wheels in opposite directions.

Figure 3:
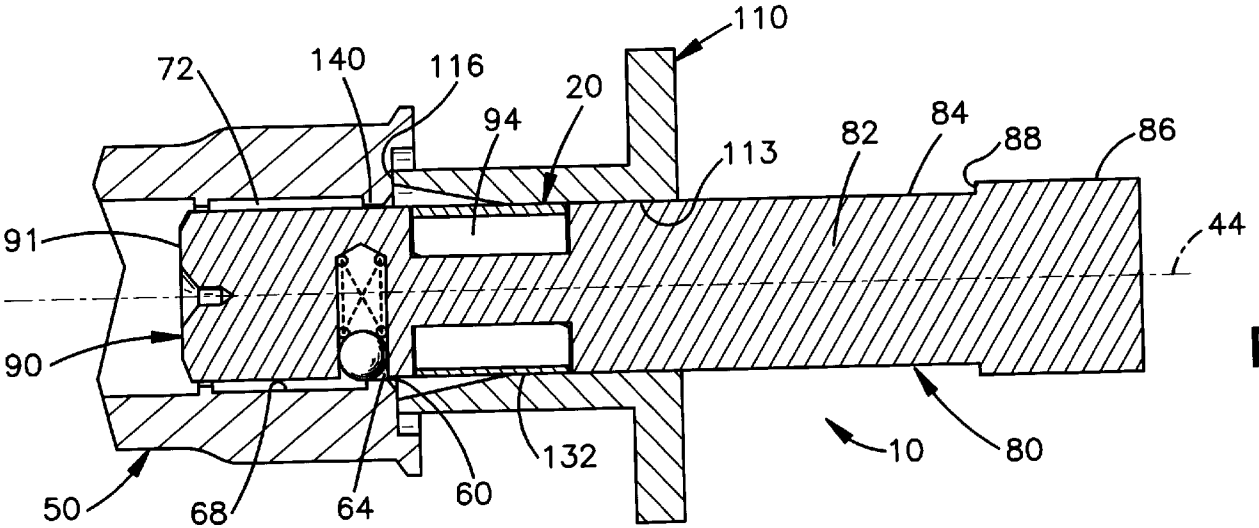
FIG. 3 is a view similar to FIG. 2 showing the bushing partially installed.
Figure 4:
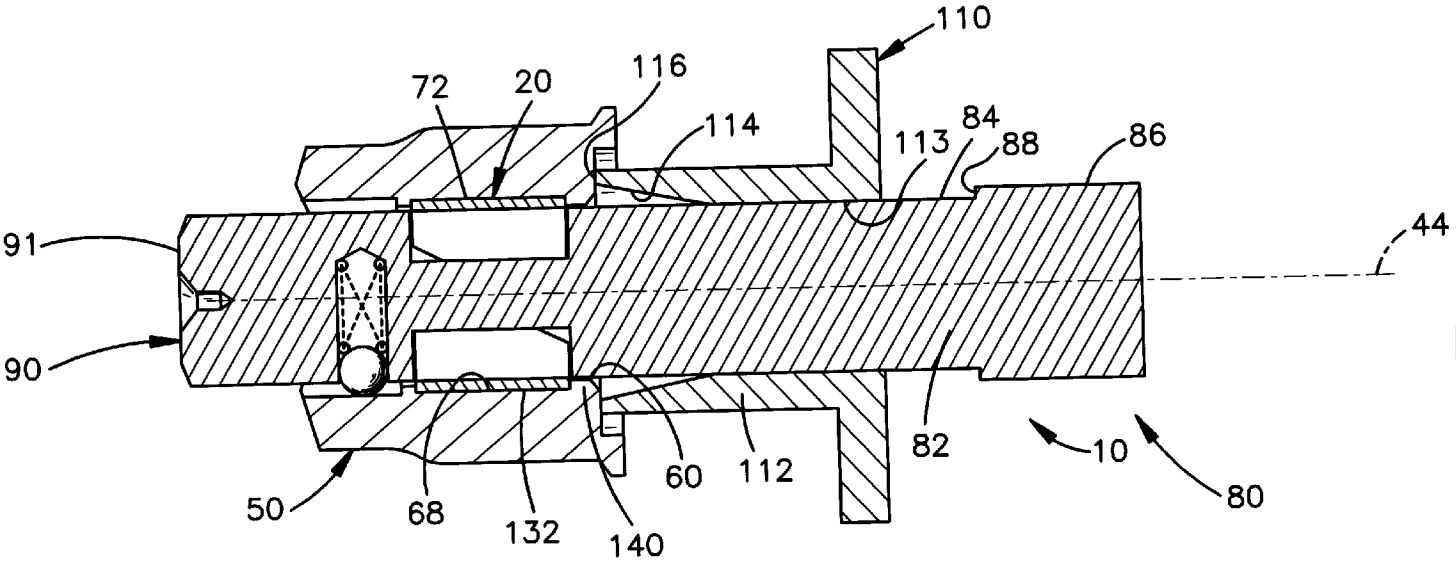
FIG. 4 is a view similar to FIG. 3 showing the bushing completely installed.

The outboard end portion 50 of the housing 30 has an outer end surface 58 that extends transverse to the axis 44. A circular opening 60 is formed in the end surface 58. The opening 60 is centered on the axis 44. The opening 60 has a first diameter. The rack 38 (not shown in FIGS. 2–4) extends out of the housing through the opening 60.

The end portion 50 of the housing 30 includes a cylindrical surface 62 that extends axially inward from the opening 60. The surface 62 defines a cylindrical passage 64 into the housing 30. The diameter of the passage 64 is the same as the first diameter of the circular opening 60.

The end portion 50 of the housing 30 includes an annular surface 66 that extends radially outward from the inner terminus of the cylindrical surface 62. Another cylindrical surface 68 extends axially inward from the annular surface 66, and another annular surface 70 extends radially inward from the cylindrical surface 68. The two annular surfaces 66 and 70 and the cylindrical surface 68 together define a ring-shaped or an annular bushing chamber 72 in the end portion 50 of the housing 30. The bushing chamber 72 is centered on the axis 44. The bushing chamber 72 has a second diameter, defined by the cylindrical surface 68, that is greater than the first diameter of the circular opening 60.

The tool 10 includes a plunger 80. The plunger 80 is preferably made from metal and has a central portion 82 with a cylindrical outer surface 84. The plunger 80 has a cylindrical trailing end portion 86 separated from the central portion 82 by an annular shoulder surface 88. The trailing end portion 86 of the plunger 80 thus has a larger diameter than the central portion 82.

The plunger 80 has a leading end portion 90 opposite the trailing end portion 86. A circular, radially extending end surface 91 of the plunger 80 is located on the leading end portion 90. The leading end portion 90 of the plunger 80 has a cylindrical outer surface 92. The leading end portion 90 of the plunger is the same diameter as the central portion 82. The diameter of the leading end portion 90 is less than the first diameter of the housing opening 60 and, therefore, is less than the second diameter of the bushing chamber 72.

A groove 94 is formed in the central portion 82 of the plunger 80 and defines the inner end of the leading end portion 90 of the plunger. The groove 94 extends circumferentially around the plunger 80. The groove 94 is defined by a pair of annular, radially extending end surfaces 96 and 98 spaced apart at opposite ends of a base surface 100. The base surface 100 is cylindrical and centered on the axis 44.

The base surface 100 of the groove 94 has a substantially smaller diameter than the central portion 82 and the leading end portion 90 of the plunger 80. The length of the groove 94, that is, the axial distance between the end surfaces 96 and 98 of the groove, is the same as or slightly larger than the length of the bushing 20. The groove 94 is thus long enough to accommodate the bushing 20 but short enough to block axial movement of the bushing along the plunger 80.

The tool 10 includes a sleeve 110, The sleeve 110 is supported on the central portion 82 of the plunger 80 for axial sliding movement along the plunger. The sleeve 110 has a tubular main body portion 112. The main body portion 112 has a cylindrical inner surface 113 that is in abutting sliding engagement with the cylindrical outer surface 84 of the central portion 82 of the plunger 80.

The sleeve 110 has a frustoconical cam surface 114 that flares radially outward from the cylindrical surface 113 to an annular, radially extending leading end surface 116 of the sleeve. The inner diameter of the sleeve leading end surface 116 is greater than the first diameter of the housing opening 60. At the other end of the sleeve 110 a gripping flange 118 extends radially outward from the main body portion 112.

The tool 10 includes a spring 120. The spring 120 is received in a cylindrical recess 122 in the leading end portion 90 of the plunger 80, between the groove 94 and the end surface 91. The outer end of the recess 122 is crimped over to hold the spring 120 and a ball 124 in the recess 122. The spring 120 biases the ball 124 radially outward in the recess 122 so that a small portion of the ball normally projects from the outer surface 92 of the leading end portion 90 of the plunger 80. The ball 124 holds the sleeve 110 on the plunger 80.

The bushing 20 is molded as one piece from a resilient plastic material. The bushing has a generally cylindrical shape including cylindrical inner and outer side surfaces 130 and 132 extending parallel to the axis 44. The bushing 20 also has annular first and second end surfaces 134 and 136 extending radially between the inner and outer side surfaces 130 and 132.

The bushing 20 is a split bushing having a slot 138 that extends between the opposite ends of the bushing. The slot 138 extends at an acute angle to the axis 44. Because of the presence of the slot 138, the bushing 20 is radially compressible and expandable.

The bushing 20 has a free or unrestrained condition in which it is resiliently expanded to its largest diameter. When the bushing 20 is in the unrestrained condition, the inner diameter of the bushing is greater than the outer diameter of the leading end portion 90 of the plunger 80. The outer diameter of the unrestrained bushing 20 is greater than the first diameter of the housing opening 60 and also is greater than the second diameter of the bushing chamber 72. Thus, the bushing 20 can not be installed into the bushing chamber 72 unless it is radially compressed.

The bushing 20 has also a fully compressed condition. In this condition, the outer diameter of the bushing 20 is smaller than the outer diameter of the leading end portion 90 of the plunger 80.

The bushing 20 has an installed condition when it is located in the bushing chamber 72. When the bushing 20 is in the installed condition, the cylindrical outer surface 132 of the bushing 20 is in abutting engagement with the cylindrical outer surface 68 of the bushing chamber 72. As a result, the outer diameter of the bushing 20 when it is in the installed condition is equal to the second diameter of the bushing chamber 72 and is greater than the first diameter of the housing opening 60.

The cylindrical inner surface 130 of the bushing 20 slidably receives the cylindrical outer surface 54 of the rack 38. The bushing 20 thus supports the rack 38 for sliding movement relative to the housing 30.

The annular surface 66 and the cylindrical surface 62 on the housing end portion 50 define an annular lip 140 disposed axially outward of the bushing chamber 72. The lip 140 has an inner diameter, which is the diameter of the opening 60 and of the passage 64, that is less than the outer diameter of the bushing chamber 72. Thus, when the bushing 20 is in the bushing chamber 72, the annular surface 66 on the lip 140 blocks axial movement of the bushing out of the bushing chamber and, therefore, out of the housing 30.

To use the tool 10, the operator slides the sleeve 110 axially toward the shoulder 88 of the plunger 80, exposing the groove 94. The operator then takes a bushing 20 that is in the unrestrained condition and slides it axially over the leading end portion 90 of the plunger 80, in a direction from the end surface 91 toward the sleeve 110.

The bushing 20 is positioned over the groove 94 in the plunger 80. The bushing 20 in this unrestrained condition is larger in diameter than the leading end portion 90 and the central portion 82 of the plunger 80.

Thus, the bushing 20 slides freely along the plunger 80 but does not drop into the groove 94.

The sleeve 110 is then moved axially along the central portion 82 of the plunger 80, toward the leading end portion 90. As this movement occurs, the cam surface 114 on the sleeve 110 engages the bushing 20 and compresses the bushing radially inward into the groove 94 in the plunger 80. (It may be necessary to start compressing the bushing manually prior to engaging it with the sleeve 110.) When the sleeve 110 moves far enough so that the cylindrical inner surface 113 on the sleeve engages the bushing 20, the bushing is radially compressed completely into the groove 94. The bushing 20 then has an outer diameter than is less than or equal to the outer diameter of the leading end portion 90 of the plunger 80.

The sleeve 110 holds the bushing 20 in the groove 94 for the next steps of the installation process. The tool 10, with the bushing 20 in place, is moved into an installation position adjacent the housing end portion 50, as shown in FIG. 2. The tool 10 is positioned relative to the housing end portion 50 so that the axis of the tool is collinear with the axis of the housing end portion. The tool 10 is moved along this line toward the housing end portion 50.

The leading end portion 90 of the plunger 80 moves through the opening 60 and into the passage 64 radially inward of the lip 140. The plunger 80 continues this movement until the leading end surface 116 of the sleeve 110 engages the outer end surface 58 of the housing portion 50. This engagement stops further movement of the sleeve 110 into the housing 30.

The plunger 80 is then pushed farther into the opening 60, moving relative to the sleeve 110. The leading end portion 90 and the central portion 82 of the plunger 80 have outer diameters less than the outer diameter of the opening 60 into the housing 30. As a result, the plunger 80 freely moves into and through the opening 60 and the passage 64. This movement of the plunger 80 carries the bushing 20 completely through the opening 60 and the passage 64 and into a position radially inward of the bushing chamber 72. The bushing 20 then springs radially outward into its installed condition in the bushing chamber 72. The cylindrical outer surface 132 of the bushing 20 is in engagement with the cylindrical outer surface 68 of the bushing chamber 72. The annular end surfaces 134 and 136 of the bushing 20 are in engagement with the annular end surfaces 66 and 70, respectively, of the bushing chamber 72. The lip 140 blocks axial movement of the bushing 20 out of the bushing chamber 72.

At this point, the tool 10 can be withdrawn from the housing end portion 50. Because the leading end portion 90 and the central portion 82 of the plunger 80 have outer diameters that are smaller than the outer diameter of the opening 60 into the housing 30, the tool 10 slides freely out of the opening.

From the above description of the invention, those skilled in the art will perceive improvements, changes and modifications in the invention. Such improvements, changes and modifications within the skill of the art are intended to be covered by the appended claims.

Having described the invention, I claim:

1. A tool for installing a bushing into a housing of a rack and pinion steering system, the housing having an end portion that includes a ring-shaped bushing chamber and a circular opening that leads into the bushing chamber, the opening having a first diameter and the bushing chamber having a second diameter greater than the first diameter of the circular opening, the bushing being radially compressible between a first, fully expanded state and a second, fully compressed state, the bushing when in the bushing chamber being partially expanded, said tool comprising:

a plunger having a first portion with an outer surface having a diameter that is less than the first diameter of the opening in the housing;

said first portion of said plunger having a circumferential groove defined by a pair of annular end surfaces extending radially inward from said outer surface and a cylindrical base surface extending axially between said end surfaces at a location radially inward of said outer surface;

said groove receiving the bushing during installation of the bushing in the housing, said annular end surfaces of said groove blocking axial movement of said bushing along said first portion of said plunger while the bushing is on said plunger; and a sleeve slidable along said first portion of said plunger to radially compress the bushing and hold the bushing in said groove during installation of the bushing in the housing;

said sleeve having an internal cam surface for radially compressing the bushing into said groove during installation of the bushing in the housing.

2. A tool as set forth in claim 1 wherein said sleeve has a leading end surface that is engageable with the outer surface of the housing end portion to block movement of said sleeve relative to said housing while enabling movement of said plunger into the circular opening in said housing.

3. A tool as set forth in claim 2 wherein said first portion of said plunger includes a leading end portion of said plunger that extends outward from said groove, said leading end portion having an outer diameter that is less than the first diameter of the opening in the housing and less than an inside diameter of the bushing when the bushing is in an unrestrained condition.

4. A tool for installing a bushing into a housing of a rack and pinion steering system, the housing having an end portion that includes a bushing chamber having a circular opening, said tool comprising:

a plunger having a leading end portion with an outer diameter that is less than an inside diameter of the bushing when the bushing is in an unrestrained condition;

said plunger having a circumferential groove which extends inward from said leading end portion of said plunger; and a sleeve slidable along said plunger to compress the bushing into said groove and hold the bushing in said groove during installation of the bushing in the housing;

said sleeve having an internal cam surface for radially compressing the bushing into said groove during installation of the bushing in the housing.

5. A tool for installing a bushing into a housing of a rack and pinion steering system, the housing having an end portion that includes a ring-shaped bushing chamber and an outer end surface having a circular opening that leads into the bushing chamber, the opening having a first diameter and the bushing chamber having a second diameter greater than the first diameter of the circular opening, the bushing being radially compressible between a first, fully expanded state and a second, fully compressed state, the bushing when in the bushing chamber being partially expanded, said tool comprising:

a plunger having a first portion with an outer surface having a diameter that is less than the first diameter of the opening in the outer end surface of the housing and said first portion of said plunger being movable through the opening in the outer end surface of the housing to locate the bushing in the bushing chamber;

said first portion of said plunger having a circumferential groove defined by a pair of annular end surfaces extending radially inward from said outer surface and a cylindrical base surface extending axially between said end surfaces at a location radially inward of said outer surface;

said groove receiving the bushing during installation of the bushing in the housing, said annular end surfaces of said groove blocking axial movement of said bushing along said first portion of said plunger while the bushing is on said plunger; and a sleeve slidable along said first portion of said plunger between an initial relative position to a second relative position, in the initial relative position said sleeve being axially spaced from said groove of said first portion of said plunger and in the second relative position said sleeve radially compressing the bushing and holding the bushing in said groove of said first portion of said plunger;

said sleeve having an end portion for engaging the outer end surface of the housing and for causing said plunger to move relative to said sleeve during movement of the first portion of said plunger through the opening in the outer end surface of the housing;

said sleeve being moved from the second relative position toward the initial relative position to release the bushing into the bushing chamber when said end portion of said sleeve engages the outer end surface of the housing and during movement of said first portion of said plunger through the opening in the outer end surface of the housing.

* * * * *